United States Patent [19]

Yoerger et al.

[11] Patent Number: 4,599,290

[45] Date of Patent: Jul. 8, 1986

[54] NEGATIVE CHARGING CARRIER PARTICLES COATED WITH A POLYMER HAVING APPENDED CHLORENDATE GROUPS

[75] Inventors: William E. Yoerger; Louis J. Sorriero, both of Rochester, N.Y.

[73] Assignee: Eastman Kodak Company, Rochester, N.Y.

[21] Appl. No.: 688,385

[22] Filed: Jan. 2, 1985

[51] Int. Cl.[4] ..... G03G 9/10

[52] U.S. Cl. ..... 430/108; 428/407

[58] Field of Search ..... 430/108; 428/407

[56] References Cited

U.S. PATENT DOCUMENTS

| | | | |
|---|---|---|---|
| 3,547,822 | 12/1970 | Miller | 252/62.1 |
| 3,672,928 | 6/1972 | Madrid et al. | 117/17.5 |
| 3,833,366 | 9/1974 | Madrid et al. | 96/1 SD |
| 3,922,381 | 11/1975 | Datta | 427/21 |
| 4,268,599 | 5/1981 | Russell, Jr. | 430/108 |

FOREIGN PATENT DOCUMENTS

| | | | |
|---|---|---|---|
| 44534 | 4/1979 | Japan | 430/108 |
| 01062 | 1/1981 | Japan | 430/108 |
| 1174573 | 12/1969 | United Kingdom . | |

*Primary Examiner*—John D. Welsh

*Attorney, Agent, or Firm*—David F. Janci

[57] ABSTRACT

A carrier for an electrographic developer composition is provided, comprising on its surface a polymer having at least one repeating unit to which is appended a monovalent chlorendate group containing a carboxylic acid group or a metal salt thereof. The carriers exhibit high negative triboelectric charging characteristics and therefore provide a highly positive developer composition.

23 Claims, No Drawings

NEGATIVE CHARGING CARRIER PARTICLES COATED WITH A POLYMER HAVING APPENDED CHLORENDATE GROUPS

FIELD OF THE INVENTION

This invention relates to the field of electrostatography. In particular, the invention relates to polymer-coated carriers for electrographic dry developers.

BACKGROUND OF THE INVENTION

In the art of electrostatography, image patterns of electrostatic charge are formed on an insulating surface by a variety of well-known methods. For example, in photoconductive methods electrostatic charge is caused to dissipate imagewise from the surface of a charged photoconductive layer toward a grounded electrode layer by exposing the layer to actinic radiation. The resulting electrostatic charge pattern is subsequently developed—or transferred to another element and developed—by contact with a developer composition.

A commonly employed developer composition comprises a dry, two-component blend of toner particles and carrier particles. The particles in such compositions are selected and formulated so that the toner particles acquire a charge of one polarity and the carrier particles acquire a charge of opposite polarity by triboelectrification. To this end, it has become common practice to coat the surface of the carrier particles with an appropriate polymer to impart by triboelectrification an electrostatic charge of the desired polarity and magnitude on the toner particles which rub against and cling to the carrier particles.

For certain applications, it is highly desirable to have a negatively charging carrier to provide a positively charged electrographic toner or to strengthen the positive charge in a weakly positive developer. (The polarity of charge on the toner is the polarity assigned to the developer so that, for example, a positively charged developer is one in which the toner particles are charged positively and in which the carrier charges negatively.)

Perfluorinated electronegative polymers have been used as carrier coatings in the art to obtain positive charging developers. However, the carriers coated with fluoropolymers are difficult to prepare, are expensive and limited in choice, and do not present as high a charge as is sometimes desired.

U.S. Pat. No. 3,672,928 discloses a carrier comprising a core coated with a crosslinked unsaturated polyester prepared from allyl esters including diallyl chlorendate. The present inventors have found in connection with their efforts to provide high negatively charging carriers that polymer coatings containing chlorendate groups in which both dicarboxylate functions are blocked (such as by divalent incorporation into the polymer backbone as in U.S. Pat. No. 3,672,928 or by reaction with cross-linking agents) do not provide sufficiently high negative charging. U.S. Pat. No. 3,672,928 further discloses that, although carriers coated with such polymers have a positive triboelectric value, they may be converted into reversal carriers by incorporating small amounts of reversal dyes into the polymer coating. In this regard, the present invention avoids the use of additives in the polymer coating on the carrier and still provides high-charging carriers of negative polarity.

SUMMARY OF THE INVENTION

In accordance with the invention, a negative triboelectric charging carrier particle is provided for use in a two-component electrographic developer composition comprising on its surface a polymer having a repeating unit comprising an appended monovalent chlorendate group containing a carboxylic acid group or a metal salt thereof.

The present invention also provides an electrographic developer composition comprising:

(a) a plurality of toner particles and (b) a plurality of carrier particles comprising on their surfaces a polymer having a repeating unit comprising an appended monovalent chlorendate group containing a carboxylic acid group or a metal salt thereof.

The carrier particles with the polymer surface defined herein exhibit high triboelectric charging values of negative polarity and thereby impart to the defined two-component developer composition a high charge of positive polarity.

DETAILED DESCRIPTION OF THE INVENTION

We have found that carrier particles comprising on their surface a polymer containing the described monovalent chlorendate groups exhibit high negative triboelectric charging values in the sense that, for any given toner, the defined chlorendate polymer provides higher positive charging levels compared with the charging levels obtained either with similar polymers without the appended monovalent chlorendate group or with conventional carrier coatings such as fluoropolymers. Furthermore, if the carboxylic acid group, or a metal salt thereof, of the surface polymer is chemically blocked (i.e., the hydrogen or metal atom is chemically replaced with another atom, group or polymer chain as disclosed in U.S. Pat. No. 3,672,928), the negative triboelectric charging characteristics will be adversely affected.

Any suitable carrier material may be employed as the carrier core. Suitable carrier cores include nonmagnetic particles such as glass beads, crystals of inorganic salts such as sodium or potassium chloride, hard resin particles, and metal particles. Preferably, magnetic particles are employed as the core. Representative magnetic carrier particles include ferromagnetic materials such as iron, cobalt, nickel and alloys, and mixtures thereof. Particularly useful magnetic particles comprise hard (i.e., permanently magnetizable) magnetic materials exhibiting (a) a coercivity of at least 300 gauss at magnetic saturation and (b) an induced magnetic moment of at least 20 EMU/gm when in an applied magnetic field of 1000 gauss. Such particularly useful materials are described in International Patent Application No. PCT/US83/01716 entitled ELECTROGRAPHIC DEVELOPER COMPOSITION AND METHOD FOR USING THE SAME, published May 10, 1984. Such hard magnetic particles include ferrites and gamma ferric oxide. Preferably, the carrier particles are composed of ferrites, which are compounds of magnetic oxides containing iron as a major metallic component. Most preferred ferrites include compounds of barium and/or strontium, such as $BaFe_{12}O_{19}$ and magnetic ferrites having the formula $MO.6Fe_2O_3$, where M is barium, strontium or lead, as disclosed in U.S. Pat. No. 3,716,630. The diameter of the carrier particles including the chlorendate-containing polymer can be from about 5 microns to about 1000 microns and preferably is from about 10 microns to about 300 microns.

A recurring unit having the monovalent chlorendate group referred to herein has the structures:

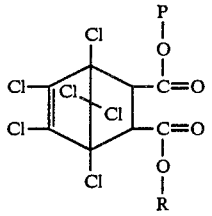

wherein P is the polymer backbone and R is hydrogen or a metal, preferably lithium. Other suitable metals include alkali metals such as sodium or potassium.

Chlorendate polymers for use on the surface of carriers of the invention can be made by well-known techniques, the objective being to append a monovalent chlorendate group to an appropriate backbone. Grafting the groups onto the backbone at reactive sites, for example, through hydroxyl groups pendant to a polyvinyl alcohol backbone, as described in U.S. Pat. No. 3,738,970 issued June 12, 1973, to Cimino et al, is a particularly useful technique. Furthermore, the desired side-chain groups can be attached to a preformed polymer backbone or to a monomeric unit thereof, and the unit subsequently polymerized.

Generally, the desired groups can be appended to a polymer backbone by esterification of the anhydride or acid of a chlorendate with a reactive hydroxyl on repeating units of the polymer backbone (or monomeric precursor).

Any of a wide variety of polymeric backbones can be employed in connection with the above-defined carrier coatings, provided the desired chlorendate groups can be appended thereto. Backbones with vinyl, acrylic or cellulose repeating units are preferred and and backbones with vinyl alcohol repeating units, such as polyvinyl alcohol, are especially preferred. Other suitable polymers are acrylics including polyacrylates produced by the esterification of a polyhydroxy alcohol with a polyacrylic acid (or monomeric precursor of such polyacid). An exemplary polyacrylate is the polymeric reaction product of ethylene glycol with polymethacrylid acid. The resulting poly(2-hydroxyethylmethacrylate) contains reactive hydroxyl groups which can participate in the esterification of chlorendate compounds. This, of course, points out that the proximity of the appended chlorendate groups to the polymer backbone can vary widely; that is, the desired groups may either be close to the backbone or removed therefrom by intervening groups, for example, having from 1 to 10 carbon atoms, preferably from 2 to 4 carbon atoms, which intervening groups are considered part of the polymer backbone. Cellulosic polymer backbones can also be employed in the invention because they generally contain reactive hydroxyl sites for reaction with the desired chlorendate groups. (A cellulose backbone contains one primary and two secondary hydroxyl groups in each repeating unit.) Other polymer backbones can also be employed whose repeating units can accept the attachment of the desired groups.

Representative polymers for use on the surface of carriers of the invention include poly(2,2,2-trifluoroethylmethacrylate-co-methacryloyloxyethylchlorendate); poly(acrylonitrile-co-methacryloyloxyethylchlorendate); poly(vinyl chlorendate); poly(vinyl chlorendate-co-vinyl lithium chlorendate); poly(vinyl lithium chlorendate); poly(vinyl chlorendate-co-vinyl alcohol); methyl cellulose chlorendate; cellulose acetate chlorendate; cellulose acetate butyrate chlorendate; poly(vinyl acetate-co-vinyl chlorendate); poly(p-fluorostyrene-co-methylmethacrylate-co-methacryloylethyl chlorendate); poly(methacryloyloxyethyl chlorendate); poly(methyl methacrylate-co-methacryloyloxyethylchlorendate); poly(vinyl butyral chlorendate) and poly(methacryloyloxyethyl chlorendate).

The polymers employed on the carrier surface in accordance with the invention include homopolymers of monomers having the desired groups branching therefrom, as well as copolymers of such monomers with one or more other monomers. In the case of vinyl materials, for example, the polymer can be polyvinylchlorendate or poly(vinylchlorendate-covinylacetate). In the case of acrylic polymers, a broad range of choice is contemplated to include such materials as homopolymers of 2-methacryloyloxyethylchlorendate or copolymers thereof with other acrylics such as methacrylic acid, methacrylates and the like. Generally, acrylic or vinyl monomers having the desired appended groups can be readily polymerized by addition polymerization with other monomers containing a polymerizable vinyl group.

Preferably, the chlorendate polymers are prepared by any of the methods described above and thereafter applied to a carrier core to form an outermost layer thereof comprising the chlorendate polymer. Preparation of the chlorendate-containing polymer and subsequent application of the polymer to the carrier is preferred, as the resulting coated carrier not only exhibits high negative charge in two-component developers, as described below, but also exhibits stabilized charge during the course of developer usage. As each carrier particle is repeatedly used and the polymer layer thereon wears away, fresh surface comprising the chlorendate polymer is continuously exposed thereby to stabilize the developer charge. Hence, in producing a large number of electrophotographic copies, image density from copy to copy remains relatively constant without the need for copy-machine adjustments.

The thickness of the outermost layer of the chlorendate polymer can vary depending in part on the diameter of the carrier core, as well as the overall diameter desired for the coated carrier. Layer thicknesses can range from about 0.001 micrometer to about 10 micrometers.

The carrier cores can be coated with an outermost layer of the chlorendate polymer by a variety of techniques such as solvent coating, spray application, plating, tumbling or melt coating. In melt coating, a dry mixture of carrier cores with a small amount of powdered chlorendate polymer, e.g., 0.05 to 5.0 weight percent resin, based on the weight of carrier is formed, and the mixture heated to fuse the polymer. Such a low concentration of polymer will form a thin outermost layer on the carrier cores.

Alternatively, the carrier core can be precoated with an appropriate polymer and the chlorendate group grafted onto the precoated polymer in accordance with the grafting procedures defined above. In such embodiment, the chlorendate polymer comprises the surface of the carrier particle but is not present to any appreciable extent within the polymer layer beneath.

Electrographic developers which are highly positively charged may be obtained by mixing carrier particles in accordance with the present invention with a suitable electroscopic toner material. The toner used with the carrier particles of this invention can be selected from a wide variety of materials to give desired physical properties to the developed image and the proper triboelectric relationship to match the carrier particles used. Generally, any of the toner particles known in the art are suitable for mixing with the carrier particles of this invention to form a developer composition.

Toner particles suitable for use in this invention are generally prepared by finely grinding a resinous material and mixing it with a coloring material such as a pigment or a dye and with any other addenda of choice, such as charge-control agents. The mixture is then ball-milled for several hours and heated so that the resin flows and encases the colorant and optional other addenda. The mass is cooled, broken into small chunks and finely ground again. After this procedure, the toner powder particles usually range in size from about 0.5 to about 25 microns, with an average size of about 2 to about 15 microns.

The resin material used in preparing the toner can be selected from a wide variety of materials as long as the desired triboelectric properties are obtained. Useful toner resins include natural resins, modified natural resins and synthetic resins. Exemplary of natural resins are balsam resins, colophony and shellac. Exemplary of modified natural resins are colophony-modified phenol resins and other resins listed below with a large proportion of colophony. Suitable synthetic resins include, for example, vinyl polymers including polyvinyl chloride, polyvinylidene chloride, polyvinyl acetate, polyvinyl acetal and polyvinyl ether; polyacrylic and polymethacrylic esters; polystyrene and substituted polystyrenes or polycondensates, e.g., polyesters, such as phthalate resins, terephthalic and isophthalic polyesters, maleinate resins and colophony-mixed esters of higher alcohols; phenol-formaldehyde resins, including colophony-modified phenol formaldehyde condensates, aldehyde resins, ketone resins, polyamides and polyadducts, e.g., polyurethanes. Moreover, polyolefins such as various polyethylenes, polypropylenes, polyisobutylenes and chlorinated rubbers are suitable. Preferred synthetic resins are polyester, polyesteramide and styrene-butylacrylate copolymers.

The polymeric toner resins can be used alone or in combination with other resins conventionally used in electrostatic toners. In this regard, blends of resins are often desirable to obtain optimum fusing, compounding and grinding properties. Useful amorphous resins generally have a glass transition temperature within the range from about 60° to 120° C. The melting point of useful crystalline resins preferably is within the range of from about 65° to about 200° C. Toner particles with such resins or blends of resins can readily be fused to conventional paper receiving sheets to form a permanent image.

The colorants useful in the toners are preferably dyestuffs or colored pigments. These materials serve to color the toner for visibility, if desired. In principle, virtually all of the compounds mentioned in the *Color Index,* Vol. I and II, Second Edition, 1956, can be used as colorants. Included among the suitable colorants are such materials as Nigrosin Spirit soluble (C.I. 50415), Hansa Yellow G (C.I. 11680), Chromogen Black ETOO (C.I. 14645), Rhodamine B (C.I. 45170), Solvent Black 3 (C.I. 26150), Fuchsine N (C.I. 42510) and C.I. Basic Blue 9 (C.I. 52015).

In addition, it may be desirable to incorporate charge-control agents into the toner particles to provide charge stability, as well as further enhancement of the level of charge. Useful charge-control agents include trimethylphenylammonium chloride as disclosed in U.S. Pat. No. 3,893,935 and stearyldimethylbenzylammonium salts as disclosed in U.S. Pat. No. 4,394,430.

The developer of the present invention is formed by mixing the defined carrier particles with toner particles in a suitable concentration. Representative developers contain up to about 50 percent toner, by weight of developer. Preferably, the developers contain from about 70 to 99 weight percent carrier and about 30 to 1 weight percent toner. Most preferably, the concentration of carrier is from about 75 to 99 weight percent and the concentration of toner is from about 25 to 1 weight percent.

The present invention, as noted, rests in part on the presence of a free acid or metal salt of an acid on the chlorendate group of the carrier coating. In the examples below, it is demonstrated that, as the acid or salt group becomes bonded to other groups such as cross-linking agents, the charging level of the resulting developer decreases. To provide useful charging levels in developers of the invention, therefore, the concentration of the chlorendate group containing the free acid, or metal salt of the acid, should be sufficient to provide a developer charge of at least +5 microcoulombs per gram of toner in the developer. In general, a degree of cross-linking is permissible provided there is otherwise sufficient concentration of chlorendate groups having free acid or metal salt to provide negative tribocharging carrier particles and preferably sufficient concentration of such chlorendates to provide in the developer the above-indicated charging level.

The charge polarity of the present developers is positive. The level of charge on the developer can vary depending, as noted above, upon the particular toner employed and the concentration of free acid, or metal salt of the acid, in the chlorendate polymer. Accordingly, the charge level of developers of the invention is at least +5 μcoul/gm of toner. For toners such as polyesters, polyesteramides and styrene-butylacrylates as employed in the examples below, the charge level of the developer is at least +15 μcoul/gram of toner in the developer, as determined in accordance with the procedure described in greater detail below. In preferred and most preferred developers of the examples below, respectively, the charge is at least +20 and at least +30 microcoulombs per gram of toner. It will be appreciated, of course, that such charging levels in the examples can be lowered or raised by changing the amount of chlorendate in the carrier polymer coating, thereby changing the effective surface amount of chlorendate to which the toner in the developer is exposed for triboelectric charging.

The following examples are included for a further understanding of the invention. In the examples, values for developer charge level and toner throw-off are reported. The developer charge level, in units of microcoulombs per gram of toner in the developer, is determined by plating the toner by electrical bias onto the electrically insulating layer of a test element. This element is composed of, in sequence, a film support, an electrically conducting (i.e., ground) layer and the insulating layer. The amount of plating is controlled to produce a mid-range reflection optical density (OD) of about 0.3. The test element containing the plated toner is connected via the ground layer to an electrometer. The plated toner is then rapidly removed in forced air, causing a flow of electric current to register in the electrometer as a charge, in microcoulombs. The registered charge is divided by the weight of the plated toner to obtain the toner charge.

Toner throw-off is determined in the following manner: A 4-gram sample of developer is placed in a vial and mixed for ½ to 2 minutes in a recipratory shaker. The mixed developer is placed on the surface of a magnetic brush roller. A funnel containing a weighed piece of fiberglass filter paper and a vacuum hose connected to its spout is inverted and placed securely over the magnetic brush. The brush is turned on for 1 minute and vacuum applied to the funnel. Afterward the filter is removed and a magnet passed thereover to remove any carrier present. The weight of the toner collected on the filter paper is reported as toner throw-off in milligrams.

EXAMPLES 1–12

The following examples illustrate carriers of the present invention and their use in two-component developers of the invention exhibiting high positive charging.

The two-component developers were prepared as follows. To 100 g of hard magnetic ferrite carrier core particles (approximately 10–35 microns in diameter) was added 1.0 g of polymer as shown in Table 1 (1 weight part polymer per 100 weight parts of carrier) dissolved in a suitable solvent such as acetone, tetrahydrofuran, or methylethyl ketone. The ferrite core particles and the polymer solution were mechanically agitated with gentle heat and air flow applied to evaporate the solvent until a free-flowing powder was obtained. The obtained powder was heated in a hot-air oven at approximately 115° to 125° C. for approximately 2 hr to cure the coated carrier. The coated carrier was then sieved through a 230 mesh screen (approximately 65-micrometer screen opening) to remove any large agglomerates and mixed for 2 minutes with a polyesteramide toner to obtain a final toner concentration of about 10%. The core particles were then magnetized and particle charge was measured and toner throw-off was determined as described herein.

The polyesteramide toner employed contained as the resin component a polyesteramide derived from terephthalic acid (100 mole %), 2,2-dimethyll,,3-propanediol (67.5 mole %), hexamethylenediamine (20 mole %), di(2-hydroxyethyl)ether (10 mole %), and pentaerythritol (2.5 mole %). The polyesteramide toner also contained bis(phthalocyanylalumino)tetraphenyldisiloxane as colorant.

Table 1 lists the results:

TABLE 1

| Example | Polymer Coating | Charge (μc/g) | Throw-off (mg) |
|---|---|---|---|
| 1. | poly(2,2,2-trifluoroethyl-acrylate-co-methacryloyl-oxyethylchlorendate) 80/20 mole percent ratio | +25.1 | 0.5 |
| 2. | poly(acrylonitrile-co-methacryloyloxyethyl-chlorendate) 80/20 | +21.0 | 1.1 |
| 3. | poly(vinyl chlorendate) (51% Cl) | +18.2 | 0.4 |
| 4. | poly(vinyl chlorendate-co-vinyl lithium chlorendate) 92.5/7.5 | +20.9 | 0.7 |
| 5. | poly(vinyl lithium chlorendate) | +25.4 | 1.3 |
| 6. | poly(vinyl chlorendate-co-vinyl alcohol) (39.6% Cl) | +34.9 | 0.1 |
| 7. | methyl cellulose chlorendate (33.5% Cl) | +25.2 | 0.7 |
| 8. | cellulose acetate chlorendate (32.0% Cl) | +34.0 | 0.8 |
| 9. | cellulose acetate butyrate chlorendate (27.8% Cl) | +29.4 | 0.4 |
| 10. | poly(vinyl acetate-co-vinyl chlorendate) 50/50 | +30.6 | 1.8 |
| 11. | poly(p-fluorostyrene-co-methylmethacrylate-co-methacryloylethyl chlorendate) 20/60/20 | +45.8 | 0.1 |
| 12. | poly(methylmethacrylate-co-methacryloyloxyethyl-chlorendate) 70/30 | +37.0 | 0.4 |

EXAMPLES 13–14

These examples illustrate developers of the present invention in which different toners are employed.

Example 12 was repeated twice, substituting in one case (Example 13) an acrylic toner for the polyesteramide toner and in the second case (Example 14) a polyester toner for the polyesteramide toner.

The acrylic toner contained, as the resin component, a styrene-butylacrylate polymer cross-linked with divinyl benzene and, as the colorant, a quinacridone magenta pigment. The acrylic toner also contained the charge-control agent stearyl dimethyl benzyl ammonium chloride.

The polyester toner employed contained as the resin component a polyester derived from 1,2-propanediol (86 mole %), 2-hydroxy-1,3-propanediol (5 mole %), terephthalic acid (86 mole %) and glutaric acid (14 mole %). The polyester toner also contained carbon black colorant and the charge-control agent methyltriphenyl phosphonium tosylate.

The charging and toner throw-off characteristics were +35.5 μcoul/gm and 0.2 mg, respectively, for the Example 13 developer, and +16.8 μcoul/gm and 0.4 mg, respectively, for the Example 14 developer.

EXAMPLE 15–18

The following examples illustrate the advantages of additional developers of the present invention compared with developers in which the carriers are coated with polymers containing no chlorendate group. The developers were prepared as described in Examples 1–12. Table 2 below lists the results obtained in terms of developer charge and toner throw-off.

TABLE 2

| | Polymer Coating | Charge (μc/g) | Throw-off (mg) |
|---|---|---|---|
| A | poly(methylmethacrylate-co-methacryloyloxyethyl-5-norbornene-2,3-dicarboxylate) 70/30 | +4.9 | 17.0 |
| 15 | as in A using the chlorendate derivative [poly-(methylmethacrylate-co-methacryloyloxyethyl chlorendate) 70/30] | +57.0 | 0.2 |
| B | poly(2-hydroxyethylmethac- | −18.4 | 10.7 |

TABLE 2-continued

| | Polymer Coating | Charge (μc/g) | Throw-off (mg) |
|---|---|---|---|
| | rylate) | | |
| 16 | poly(methacryloyloxyethyl chlorendate) | +57.7 | 0.3 |
| C | poly(methylmethacrylate) | −21.7 | 3.2 |
| D | poly(methylmethacrylate-co-2-hydroxyethyl methacrylate) 70/30 | −31.5 | 0.5 |
| 17 | poly(methylmethacrylate-co-methacryloyloxyethyl-chlorendate) 90/10 | +37.5 | 0.6 |
| E | Butvar B-76, a poly(vinyl butyral) available from Monsanto Chemical Corporation, St. Louis, Mo. | −25.2 | 115.3 |
| F | Butvar B-98, a poly(vinyl butyral) available from Monsanto Chemical Corporation | −21.2 | 1.6 |
| 18 | poly(vinyl butyral chlorendate) | +37.4 | 0.4 |

As can be seen from the above table, developers containing the chlorendate-polymer-coated carriers of the present invention (Examples 15, 16, 17, 18) have high positive charge compared with those prepared with carriers coated with polymers containing no chlorendate group (Examples A, B, C, D, E, F).

EXAMPLES 19–21

The following examples illustrate the magnitude of the positive charge on developers of the present invention (19–21) compared with developers in which the carrier is coated with commercially available fluoropolymers (G–I).

The following materials (Table 3) were prepared and tested as described in Examples 1–12.

TABLE 3

| | Polymer Coating | Charge (μc/g) | Throw-off (mg) |
|---|---|---|---|
| G | a poly(vinylidene fluoride) (KYNAR-301 available from Pennwalt, Philadelphia, Pa.) | +19.7 | 1.7 |
| H | a poly(vinylidene fluoride-co-tetrafluoroethyl (KYNAR-7201 available from Pennwalt | +23.3 | 0.7 |
| I | a poly(vinylidene fluoride-co-trifluorochloroethylene) (KEL F-800 available from 3M Co., St. Paul, Minn.) | +22.2 | 0.7 |
| 19 | poly(methacryloyloxyethyl chlorendate) | +57.7 | 0.3 |
| 20 | cellulose acetate chlorendate | +34.0 | 0.8 |
| 21 | poly(vinylbutyral chlorendate) | +37.4 | 0.4 |

EXAMPLES 22–29

The following examples illustrate the effect of blocking the acid group, or metal salt thereof on the chlorendate group in the polymer coating of the present carriers.

As noted herein, it has been found that the free carboxylic acid group or metal salt thereof in the subject polymer coatings is required to provide the maximum level of electronegativity in the carrier (and thus the most positive charge to the developer). This example illustrates that, when the acid group is blocked by reaction with a cross-linking agent, the charge level decreases. The following materials (Table 4) were prepared and tested as described in Examples 1–12. In this example, the cross-linking agent employed was an epichlorohydrinbisphenol A-type epoxy resin (Epon 812 from Shell International). Curing took place at 125° C. for 2 hr; a trace amount of N,N-dimethylbenzylamine was added to facilitate the epoxy cure. The percentage amounts of cross-linking agent employed were based on the weight of carrier polymer coating. The following data were obtained (Examples 23–25).

Examples 26–29 illustrate that simple dilution of the polymer with polymers which did not cross-link (i.e., tie up the active acid sites) did not significantly reduce the charge. The percentages of diluent polymer and chlorendate polymer are based on the combined weight of both polymers.

TABLE 4

| | Polymer Coating | Charge (μc/g) | Throw-off (mg) |
|---|---|---|---|
| 22 | control [poly(methylmethacrylate-co-methacrylate-co-methacryloyloxyethyl chlorendate) 70/30] | +41.3 | 0.4 |
| Cross-linked Chlorendate Polymer Samples: | | | |
| 23 | control + 5% Epon 812 | +32.0 | 0.2 |
| 24 | control + 10% Epon 812 | +30.2 | 0.2 |
| 25 | control + 15% Epon 812 | +23.2 | 0.4 |
| Diluted Chlorendate Polymer Samples: | | | |
| 26 | 80% control + 20% Elvacite 2010, a poly(methylmethacrylate from duPont) | +40.7 | 0.1 |
| 27 | 60% control + 40% Elvacite 2010 | +40.3 | 0.2 |
| 28 | 40% control + 60% Elvacite 2010 | +39.8 | 0.2 |
| 29 | 0% control + 100% Elvacite 2010 | −33.4 | 0.3 |

EXAMPLE 30

The following example illustrates the improvement which a carrier coated with a chlorendate polymer in accordance with the invention exhibits over carriers coated with polymers in which the acid groups of a chlorendate group are chemically blocked by divalent incorporation of the chlorendate into a polymer backbone.

TABLE 5

| | Polymer Coating | Charge (μc/g) | Throw-off (mg) |
|---|---|---|---|
| J | poly(tetramethylene chlorendate co-isophthalate) 80/20 | +14.4 | 1.2 |
| K | poly(tetramethylene chlorendate co-sebacate) 80/20 | +13.8 | 0.9 |
| 30 | poly(methylmethacrylate-co-methacryloyloxyethyl chlorendate) 70/30 | +41.3 | 1.1 |

J and K contain chlorendate groups divalently incorporated into a polymer backbone and therefore do not have free carboxylic acid groups or metal salts thereof. Example 30 is a polymer coating in accordance with the invention and contains a monovalent chlorendate group containing a free acid group.

As can be seen from Table 5, runs J and K, polymers in which the chlorendate acid groups are blocked exhibit significantly lower magnitude charging than chlorendate groups containing free acid groups.

The invention has been described in detail with particular reference to preferred embodiments thereof, but it will be understood that variations and modifications can be effected within the spirit and scope of the invention as described hereinabove and as defined in the appended claims.

What is claimed is:

1. A negative tribocharging carrier particle for use in a two-component electrographic developer composition, comprising on its surface a polymer having a repeating unit comprising an appended monovalent chlorendate group containing a carboxylic acid group, or a metal salt thereof.

2. A carrier particle as described in claim 1 wherein said unit has the structure:

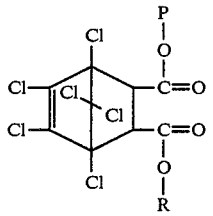

wherein P is the polymer backbone and R is hydrogen or a metal.

3. A carrier particle as described in claim 1 or 2 wherein P is a vinyl, acrylic or cellulose backbone.

4. A carrier particle as described in claim 1 wherein said polymer is poly(2,2,2-trifluoroethylmethacrylate-co-methacryloyloxyethylchlorendate); poly(acrylonitrile-co-methacryloyloxyethylchlorendate); poly(vinyl chlorendate); poly(vinyl chlorendate-co-vinyl lithium chlorendate); poly(vinyl lithium chlorendate); poly(vinyl chlorendate-co-vinyl alcohol); methyl cellulose chlorendate; cellulose acetate chlorendate; cellulose acetate butyrate chlorendate; poly(vinyl acetate-co-vinyl chlorendate); poly(p-fluorostyrene-co-methylmethacrylate-co-methacryloylethyl chlorendate); poly(methacryloyloxyethyl chlorendate); poly(methyl methacrylate-co-methacryloyloxyethylchlorendate); poly(vinyl butyral chlorendate) and poly(methacryloyloxyethyl chlorendate).

5. A negative tribocharging carrier particle for use in a two-component electrographic developer composition, comprising a core and a surface layer on said core comprising a polymer having a repeating unit comprising an appended monovalent chlorendate group containing a carboxylic acid group, or a metal salt thereof.

6. A carrier particle as described in claim 5 wherein said unit has the structure:

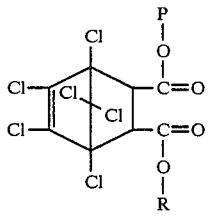

wherein P is the polymer backbone and R is hydrogen or a metal.

7. A carrier particle as described in claim 5 or 6 wherein P is a vinyl, acrylic or cellulose backbone.

8. A carrier particle as described in claim 5 wherein said polymer is poly(2,2,2-trifluoroethylmethacrylate-co-methacryloyloxyethylchlorendate), poly(acrylonitrile-co-methacryloyloxy-ethylchlorendate), poly(vinyl chloroendate), poly(vinyl chlorendate-co-vinyl lithium chlorendate), poly(vinyl lithium chlorendate), poly(vinyl chlorendate-co-vinyl alcohol, methyl cellulose chlorendate, cellulose acetate chlorendate, cellulose acetate butyrate chlorendate, poly(vinyl acetate-co-vinyl chlorendate), poly(p-fluorostyrene-co-methylmethacrylate-co-methacryloylethyl chlorendate), poly(methacryloyloxyethyl chlorendate), poly(methylmethacrylate-co-methacryloyloxyethyl chlorendate), poly(vinyl butyral chlorendate) and poly(methacryloyloxyethyl chlorendate).

9. A carrier particle as described in claim 5 wherein said core comprises a magnetic material.

10. A carrier particle as described in claim 5 wherein the thickness of said polymer layer is from about 0.001 micrometer to about 10 micrometers.

11. A carrier particle as described in claim 5 wherein the diameter of said carrier particle is from about 5 micrometers to about 1000 micrometers.

12. A carrier particle as described in claim 5 wherein the diameter of said carrier particle is from about 10 micrometers to about 300 micrometers.

13. An electrographic developer composition comprising:

(a) a plurality of toner particles and (b) a plurality of carrier particles having on their surfaces a polymer having a repeating unit comprising an appended monovalent chlorendate group containing a carboxylic acid group or a metal salt thereof.

14. An electrographic developer composition as described in claim 13 wherein said carrier particles each comprise a core and an outermost surface layer on said core comprising a polymer having a repeating unit comprising an appended monovalent chlorendate group containing a carboxylic acid group, or a metal salt thereof.

15. An electrographic developer composition as described in claim 13 or 14 wherein said toner comprises a polyester, polyesteramide, or an acrylic polymer.

16. An electrographic developer composition as described in claim 13 or 14 having a positive developer charge of at least 5 microcoulombs per gram of toner in the developer.

17. An electrographic developer composition as described in claim 15 having a positive developer charge of at least 15 microcoulombs per gram of toner in the developer.

18. An electrographic developer composition as described in claim 13 or 14 wherein said unit has the structure:

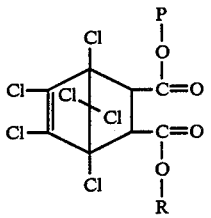

wherein P is the polymer backbone and R is hydrogen or a metal.

19. An electrographic developer composition as described in claim 13, 14 or 18 wherein P is a vinyl, acrylic or cellulose backbone.

20. An electrographic developer composition as described in claim 19 wherein said polymer is poly(2,2,2-trifluoroethylmethacrylate-co-methacryloyloxyethylchlorendate), poly(acrylonitrile-co-methacryloyloxyethylchlorendate), poly(vinyl chlorendate), poly(vinyl chlorendate-co-vinyl lithium chlorendate), poly(vinyl lithium chlorendate), poly(vinyl chlorendate-co-vinyl alcohol, methyl cellulose chlorendate, cellulose acetate chlorendate, cellulose acetate butyrate chlorendate, poly(vinyl acetate-co-vinyl chlorendate), poly(p-fluorostyrene-co-methylmethacrylate-co-methacryloylethyl chlorendate), poly(methacryloyloxyethyl chlorendate), poly(methylmethacrylate-co-methacryloyloxyethyl chlorendate), poly(vinyl butyral chlorendate) and poly(methacryloyloxyethyl chlorendate).

21. An electrographic developer composition as described in claim 14 wherein said core comprises a magnetic material.

22. An electrographic developer composition as described in claim 14 wherein the thickness of said polymer layer is from about 0.001 micrometer to about 10 micrometers.

23. An electrographic developer composition as described in claim 14 wherein the diameter of said carrier particles is from about 10 micrometers to about 300 micrometers.

* * * * *